US009897966B2

(12) United States Patent
Haga

(10) Patent No.: US 9,897,966 B2
(45) Date of Patent: Feb. 20, 2018

(54) IMAGE FORMATION APPARATUS AND METHOD FOR CONTROLLING THE SAME

(71) Applicant: KONICA MINOLTA, INC., Chiyoda-ku, Tokyo (JP)

(72) Inventor: Masayasu Haga, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/588,598

(22) Filed: May 6, 2017

(65) Prior Publication Data

US 2017/0336750 A1 Nov. 23, 2017

(30) Foreign Application Priority Data

May 23, 2016 (JP) ..... 2016-102208

(51) Int. Cl.
*G03G 21/00* (2006.01)
*G03G 15/00* (2006.01)

(52) U.S. Cl.
CPC ..... *G03G 21/0094* (2013.01); *G03G 15/5041* (2013.01)

(58) Field of Classification Search
CPC ..... G03G 21/0094; G03G 15/5041
USPC ..... 399/71
See application file for complete search history.

(56) References Cited

U.S. PATENT DOCUMENTS 8,433,213 B2 * 4/2013 Hozumi ..... G03G 15/161 399/101
9,400,455 B2 * 7/2016 Cannon ..... G03G 15/161

FOREIGN PATENT DOCUMENTS

| | | | |
|---|---|---|---|
| JP | 2004109513 A | | 4/2004 |
| JP | 2005077717 A | * | 3/2005 |
| JP | 2006235563 A | | 9/2006 |
| JP | 2006276065 A | | 10/2006 |
| JP | 2013007850 A | * | 1/2013 |
| JP | 2013182126 A | * | 9/2013 |

* cited by examiner

*Primary Examiner* — Susan Lee
(74) *Attorney, Agent, or Firm* — Holtz, Holtz & Volek PC

(57) ABSTRACT

An image formation apparatus includes: an image carrier; a developing device which develops an electrostatic latent image formed on the image carrier as a toner image; a transfer device which transfers the toner image to a medium; a cleaning device which recovers toner remaining on the image carrier after the toner image is transferred; and a lubricant application adjustment mechanism which applies a lubricant on the image carrier and recovers toner present on the image carrier upstream of the cleaning device; and a controller which controls the lubricant application adjustment mechanism. The controller causes the lubricant application adjustment mechanism to recover more toner when the toner image formed on the image carrier has a larger image area ratio.

20 Claims, 10 Drawing Sheets

IMAGE FORMATION APPARATUS AND METHOD FOR CONTROLLING THE SAME

This application is based on Japanese Patent Application No. 2016-102208 filed with the Japan Patent Office on May 23, 2016, the entire content of which is hereby incorporated by reference.

BACKGROUND OF THE INVENTION

Field of the Invention

The present disclosure relates to an image formation apparatus having a function to feed a lubricant on an image carrier, and a control method in the image formation apparatus.

Description of the Related Art

Conventionally, electrophotographic image formation apparatuses such as multifunction peripherals, copiers, and printers, are widely used. Such an electrophotographic image formation apparatus generally includes an image carrier having a surface on which a toner image is formed while the image carrier is rotatably driven, a transfer device which transfers the formed toner image to a transfer body or a medium, and a cleaning device for removing residual toner such as toner on the image carrier that is not yet transferred and toner remaining after the transfer. As the cleaning device, a blade cleaning system is typically known in which a cleaning blade in the form of a flat plate composed of an elastic body is abutted against a surface of the image carrier to remove residual toner on the image carrier.

As a prior art regarding such a blade cleaning system, Japanese Laid-Open Patent Publication No 2006-276065 discloses an image formation apparatus characterized by controlling an operation of a cleaning means depending on an average image density sensed from an input image signal.

The blade cleaning system has a cleaning ability which may vary as it is also affected by various factors other than the average image density mentioned in Japanese Laid-Open Patent Publication No. 2006-276065. As a typical example of such a factor of variation, a cleaning blade's edge wear is referred to. As the edge portion is worn, it contacts the image carrier in an increased area, which results in a reduced peak pressure and hence an impaired cleaning ability. The impaired cleaning ability increases a possibility of failing to wiping off toner, i.e., a possibility or poor cleaning. To address such an issue, for the purpose of enhancing the cleaning blade's cleaning ability and also suppressing wear of a photosensitive layer of the image carrier, a lubricant feeding device which feeds a lubricant on the image carrier may be provided.

As a prior art regarding such a lubricant feeding device, Japanese Laid-Open Patent Publication No. 2004-109513 discloses an image formation apparatus which uses a waste toner as a lubricant to prevent wasteful use of toner to satisfy toner yield.

Furthermore, Japanese Laid-Open Patent Publication No. 2006-235563 discloses as issues that when images with small image areas are successively provided, there is a small amount of toner present at a cleaning unit so that it is difficult to shave a lubricant and accordingly, the amount the lubricant fed to the photoreceptor decreases, and it is thus difficult to decrease the photoreceptor's coefficient of friction, and that when images with significantly large image area ratios are successively provided, toner will be input in an increased amount and a brush roller will hold more toner, which decreases applicability to the photoreceptor and toner dammed up by the cleaning blade would scrape off the lubricant on the photoreceptor, resulting in the photoreceptor having an increased coefficient of friction. To address such an issue, Japanese Laid-Open Patent Publication No. 2006-235563 discloses a solution means as follows: for an average image area ratio of 5% or less of an immediately previous prescribed image forming period, toner is intentionally input into the cleaning means before a lubricant applying operation, whereas for an average image area ratio of 20% or more of an immediately previous prescribed image forming period, the lubricant applying operation is performed for a long period of time.

In order to allow the lubricant fed on the image carrier to exhibit its essential function appropriately, it is preferable that the thickness of a coating lubricant layer formed on a surface of the image carrier (or the amount of the lubricant present on the surface of the image carrier) be maintained constantly. In order to maintain the thickness of the coating lubricant layer constantly, an amount of the lubricant fed by a lubricant applying function per unit time (hereinafter also referred to as a "lubricant feeding rate") and an amount of the lubricant recovered at an edge located at a tip of the cleaning blade (hereinafter also referred to as a "blade edge") per unit time (hereinafter also referred to as a "lubricant recovery rate") may be balanced.

However, it is known that the lubricant recovery rate at which the cleaning blade wears and thus recovers the coating lubricant layer depends on the amount of the toner fed to the blade edge. In forming an image when an image area ratio (hereinafter also referred to as a "coverage") varies, the amount of the toner fed to the blade edge will vary, and as the toner's amount varies, the lubricant recovery rate will also vary. As a result, the lubricant feeding rate and the lubricant recovery rate would be out of balance, and the thickness of the coating lubricant layer on the surface of the image carrier would vary.

While Japanese Laid-Open Patent Publication No. 2006-276065 discloses performing control in accordance with an average image density, it does not disclose at all adopting a lubricant feeding device, and does not solve the above described issue. Furthermore, Japanese Laid-Open Patent Publication No. 2004-109513 only discloses using a waste toner as a lubricant, and does not solve the above described issue.

In contrast, Japanese Laid-Open Patent Publication No. 2006-235563 discloses a solution means for an issue similar to the above described issue, as follows: in accordance with an average image area ratio of an immediately previous prescribed image forming period, toner is intentionally input into a cleaning means before a lubricant applying operation or the lubricant applying operation is performed for an increased period of time. However, the solution means disclosed in Japanese Laid-Open Patent Publication No. 2006-235563 is accompanied by such a disadvantage that starting the lubricant applying operation is delayed or the lubricant applying operation is performed for a long period of time.

SUMMARY OF THE INVENTION

One object of the present disclosure is to stabilize a thickness of a coating lubricant layer formed on a surface of an image carrier (or an amount of a lubricant present on the surface of the image carrier) without affecting an operation of a lubricant applying function.

An image formation apparatus according to an embodiment includes: an image carrier; a developing device which develops an electrostatic latent image formed on the image carrier as a toner image, a transfer device which transfers the toner image to a medium, a cleaning device which recovers toner remaining on the image carrier after the toner image is transferred; and a lubricant application adjustment mechanism which applies a lubricant on the image carrier and recovers toner present on the image carrier upstream of the cleaning device; and a controller which controls the lubricant application adjustment mechanism. The controller causes the lubricant application adjustment mechanism to recover more toner when the image area ratio of the toner image formed on the image carrier is larger.

When the image area ratio is larger, the controller may exert control to enhance an ability to recover toner by the lubricant application adjustment mechanism, and when the image area ratio is smaller, the controller may exert control to lower the ability to recover toner by the lubricant application adjustment mechanism.

The lubricant application adjustment mechanism may include: a first abutment member for applying a lubricant to the image carrier; and a second abutment member for recovering toner present on the image carrier.

The second abutment member may include at least one of a brush and a roller. The controller may change at least one of a speed of rotation of the second abutment member and a direction of rotation thereof to control the ability to recover the toner.

The second abutment member may include a conductive member. The controller may change at least one of a magnitude of a bias voltage applied to the second abutment member and a polarity thereof to control the ability to recover the toner.

The lubricant application adjustment mechanism may include an abutment member for applying a lubricant to the image carrier and recovering toner.

The controller may change at least one of a speed of rotation of the abutment member and a direction of rotation thereof to control the ability to recover the toner.

The controller may use as the image area ratio of a toner image an average image area ratio throughout an image formation region on the image carrier.

The controller may adopt as the image area ratio a minimum value of image area ratios respectively of a plurality of divided regions divided in a main scanning direction of the image carrier.

When a predetermined condition is established, the controller may exerts control to form on the image carrier a toner image based on a patch image corresponding to the image area ratio, and cause the lubricant application adjustment mechanism to process the toner image corresponding to the patch image.

The predetermined condition may include at least one of: a time when the image formation apparatus is powered on; a time before an image is formed for an input image; and a time after an image is formed for an input image.

The predetermined condition may be determined based on at least one of: the image carrier's total use time; the developing device's total use time; a period of time for which the image formation apparatus is left without forming any image; and an environment in which the image formation apparatus is installed.

The controller may exclude the patch image's image area ratio from the image area ratio used for controlling the lubricant application adjustment mechanism.

According to an embodiment, a control method in an image formation apparatus is provided. The image formation apparatus includes: an image carrier, a developing device which develops an electrostatic latent image formed on the image carrier as a toner image; a transfer device which transfers the toner image to a medium; a cleaning device which recovers toner remaining on the image carrier after the toner image is transferred; and a lubricant application adjustment mechanism which applies a lubricant on the image carrier and recovers toner present on the image carrier upstream of the cleaning device. The control method includes obtaining an image area ratio of a toner image formed on the image carrier, and controlling the lubricant application adjustment mechanism to recover more toner when the obtained image area ratio is larger.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention will now be described in embodiments hereinafter in detail with reference to the drawings. Note that in the figures, identical or corresponding components are identically denoted, and will not be described repeatedly.

A. General Configuration of Apparatus

Initially, a general configuration of an image formation apparatus 100 according to the present embodiment will be described. Hereinafter, while image formation apparatus 100 which is a color image formation apparatus mounted as a multi-functional peripheral (MFP) will be illustrated as a typical example, it is not necessarily limit to the color image formation apparatus, and it is also applicable to a monochrome image formation apparatus. Furthermore, while a tandem system will be illustrated as a mechanism which forms a color image, a cycle system (typically, a 4-cycle system) is also applicable.

Figure 1:
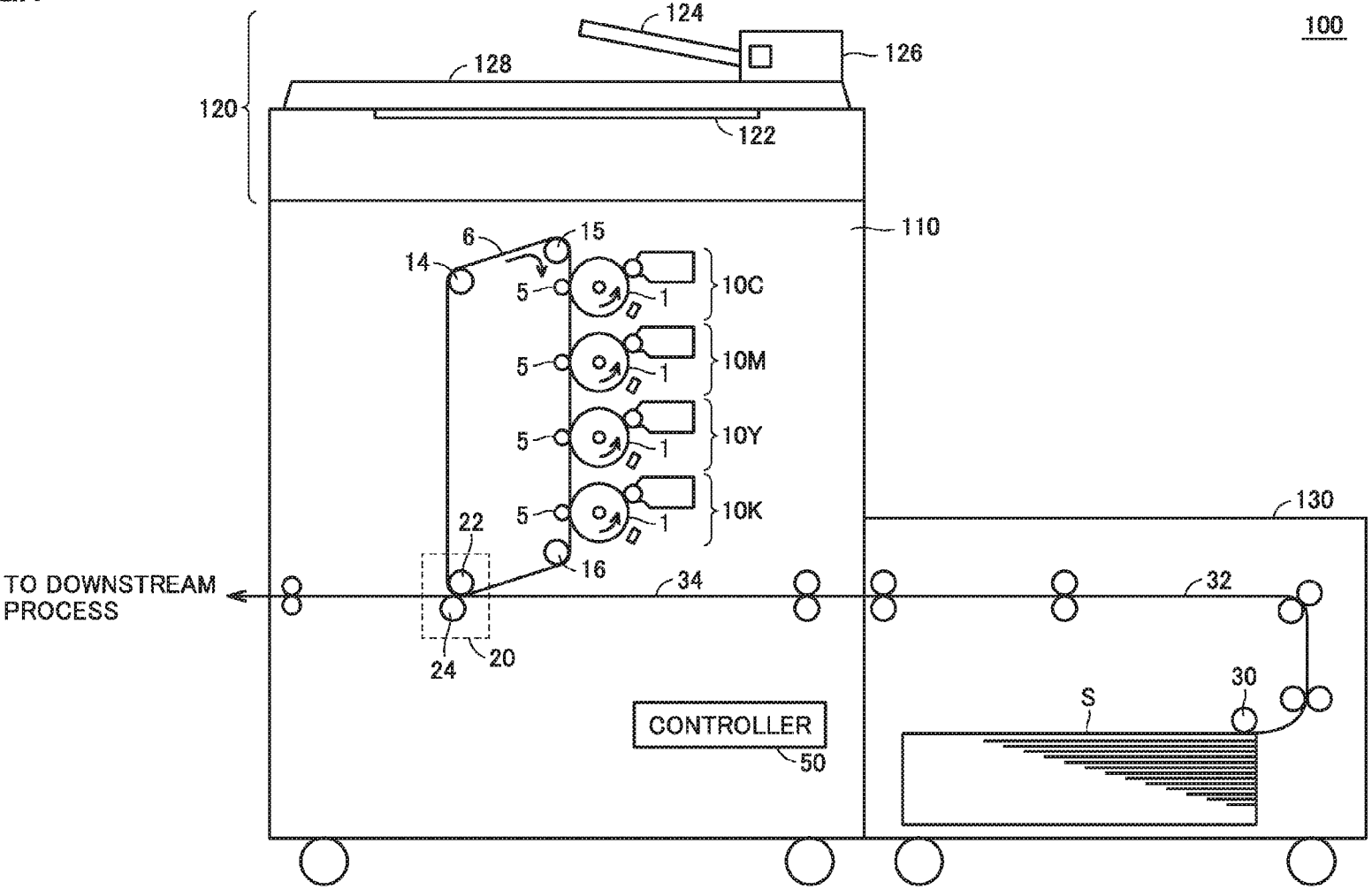
FIG. 1 is a schematic diagram showing a general configuration of an image formation apparatus according to an embodiment.

With reference to FIG. 1, a general configuration of image formation apparatus 100 according to the present embodiment will be described. Image formation apparatus 100 includes a print engine 110, an original reading unit 120, and a sheet feeding unit 130.

Print engine 110 performs an electrophotographic image formation process. The configuration shown in FIG. 1 allows full-color printout. A medium S printed out is discharged to a downstream process.

Original reading unit 120 reads an original and outputs the read result as an input image to print engine 110. More specifically, original reading unit 120 includes an image scanner 122, an original feeding plate 124, an automatic original feeder 126, and an original discharging table 128.

Image scanner 122 scans an original disposed on the platen glass. Image scanner 122 includes as main components a light source which irradiates the original with light, an image sensor which obtains an image which is generated as the light emitted from the light source is reflected by the original, an AD (analog-to-digital) converter for outputting an image signal from the image sensor, and an imaging optical system disposed at a stage preceding the image sensor.

Automatic original feeder 126 successively scans the original disposed on original feeding plate 124. The original disposed on original feeding plate 124 is delivered, one at a time, by a delivery roller (not shown) and successively scanned by image scanner 122 or an image sensor disposed within automatic original feeder 126. The scanned original is discharged to original discharging table 128.

Sheet feeding unit 130 feeds medium S successively to print engine 110. Specifically, sheet feeding unit 130 successively delivers held media S by a delivery roller 30, and also transports the delivered medium S to print engine 110 along a transport path 32.

In print engine 110, medium S fed from sheet feeding unit 130 is transported to a discharging port along a transport path 34. In the process of transporting medium S along transport path 34, a fixing device 20 transfers and fixes a toner image to medium S. Fixing device 20 includes a pressure applying roller 22 and a heating roller 24, and transfers to medium S a toner image formed on an intermediate transfer body 6.

Print engine 110 includes imaging units 10C, 10M, 10Y, and 10K (hereinafter also collectively referred to as an "imaging unit 10") forming images of cyan (C), magenta (M), yellow (Y), and black (K), respectively.

In FIG. 1 is shown by way of example a configuration in which a toner image formed by each imaging unit 10 is transferred via the intermediate transfer body to a member to which the toner image is transferred, i.e., medium S. Image formation apparatus 100 includes as the intermediate transfer body an intermediate transfer body 6 tensioned by intermediate transfer body driving rollers 14, 15, and 16. Intermediate transfer body 6 is rotated in a prescribed direction as intermediate transfer body driving rollers 14, 15, and 16 are rotatably driven. As intermediate transfer body 6, an intermediate transfer belt shown in FIG. 1 may be replaced with an intermediate transfer roller. Note that while FIG. 1 shows by way of example a configuration in which after a toner image has once been transferred to the intermediate transfer body the toner image is transferred to medium S by fixing device 20, a toner image on photoreceptor 1 may be transferred directly to medium S.

Imaging units 10C, 10M, 10Y, and 10K are disposed in that order along intermediate transfer body 6 tensioned in print engine 110 and rotatably driven. Each imaging unit 10 includes a photoreceptor 1 and an intermediate transfer device 5 disposed opposite to each other with intermediate transfer body 6 interposed. Around photoreceptor 1 are disposed a charging device, an exposure device, a developing device, and a cleaning device. These devices will more specifically be described later.

Print engine 110 includes a controller 50 which generally controls image formation apparatus 100. Controller 50 includes as main components a processor such as a CPU (Central Processing Unit), a volatile memory such as DRAM (Dynamic Random Access Memory), a non-volatile memory such as HDD (Hard Disk Drive), and various interfaces. Typically, in print engine 110, the processor executes various programs stored in the non-volatile memory to perform a process or the like involved in forming an image in image formation apparatus 100.

While controller 50 is implemented by the processor executing a program, alternatively, the process may entirely or partially be implemented using dedicated hardware. Furthermore, when the processor executes a program, the program may be installed to the non-volatile memory via various storage media or may be downloaded from a server device etc. (not shown) via a communication line.

B. Imaging Unit and Image Forming Operation

Hereinafter, a configuration of imaging unit 10 configuring print engine 110 of image formation apparatus 100, and an image forming operation using imaging unit 10 will be described according to the present embodiment.

Figure 2:
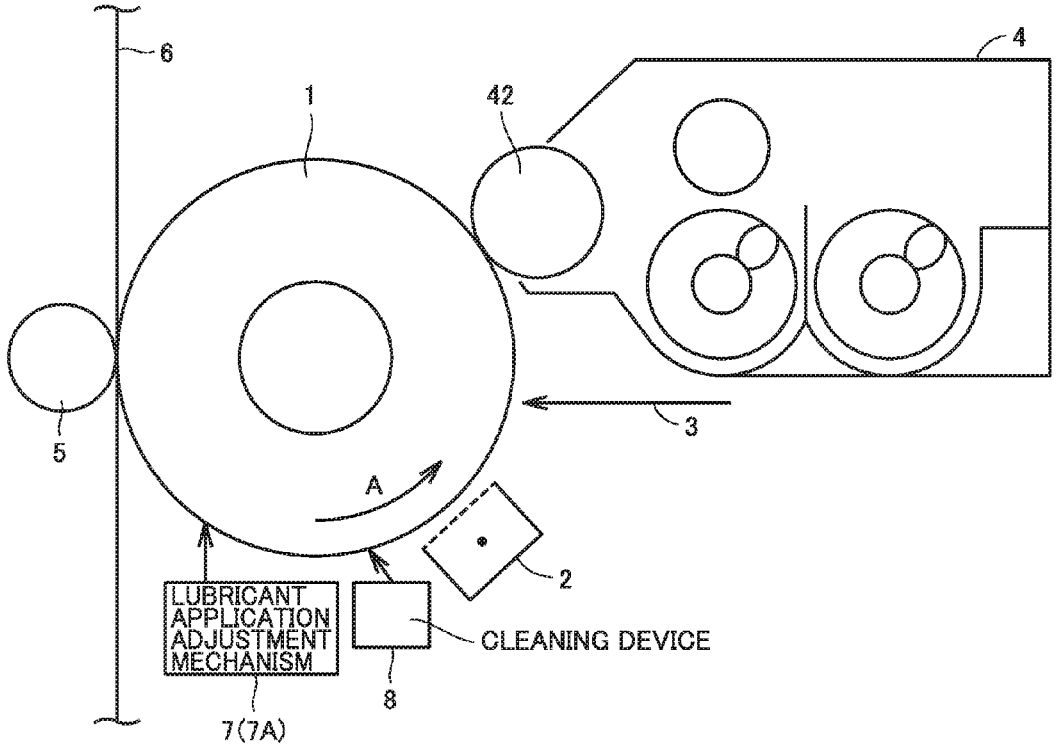
FIG. 2 is a schematic diagram of an imaging unit of the image formation apparatus according to the present embodiment.

With reference to FIG. 2, in imaging unit 10 of image formation apparatus 100 according to the present embodiment, around photoreceptor 1, a charging device 2, an exposure device 3, a developing device 4, and a cleaning device 8 are disposed.

Photoreceptor 1 is an image carrier which carries a toner image thereon, and a photoreceptor roller having a surface with a photosensitive layer formed thereon is used therefor. Photoreceptor 1 is disposed to allow a toner image to be formed on a surface thereof and also rotates in a direction corresponding to a direction in which intermediate transfer body 6 rotates. Note that as the image carrier, the photoreceptor roller may be replaced with a photoreceptor belt. On photoreceptor 1, an electrostatic latent image is formed by exposure device 3, and by developing device 4, the electrostatic latent image is developed to form a toner image.

Charging device 2 includes an electrifying charger etc., and charges a surface of photoreceptor 1 uniformly to attain a prescribed potential.

Exposure device 3 exposes a surface of photoreceptor 1 by laser writing etc. according to a designated image pattern to form an electrostatic latent image on that surface. Typically, exposure device 3 includes a laser diode which generates laser light, and a polygon mirror which exposes the surface of photoreceptor 1 to the laser light along a main scanning direction.

Developing device 4 has a developing sleeve 42 disposed opposite to photoreceptor 1 with a developing area interposed, and uses developing sleeve 42 to develop the electrostatic latent image formed on photoreceptor 1 as a toner image. Applied to developing sleeve 42 is a developing bias with an alternating current voltage superposed on a direct current voltage of the same polarity as the charging polarity of charging device 2, for example, and by this developing bias, toner adheres to the electrostatic latent image formed by exposure device 3.

As a developer used in developing device 4, a two-component based developer which includes toner and a career for charging the toner can typically be used. The toner is not limited to any particular toner, and a known toner can be used. For example, a binder resin which has a colorant and, as required, a charge controlling agent and a release agent, etc. contained therein and in that condition, has an external additive added thereto, may be used as the toner. As the external additive, fine particles of a metal oxide such as silica and titanium can be used, and fine particles thereof ranging from a small particle diameter of 30 nm to a relatively large particle diameter of 100 nm may be used. The toner's particle diameter is not particularly limited, and preferably, it is about 3-15 μm for example. The carrier is not limited to any particular carrier and a known carrier can be used. For example, a binder type carrier, a coat type carrier, etc. can be used. The carrier's particle diameter is not limited to any particular particle diameter, and preferably it is 15 to 100 μm for example. Note that the two-component based developer is not exclusive and a monocomponent based developer (i.e., toner) may be used.

The toner image formed on photoreceptor 1 by developing device 4 is carried to a transfer region formed between photoreceptor 1 and intermediate transfer device 5. To intermediate transfer device 5 is applied a transfer bias opposite in polarity to the charging polarity of the toner, and by this transfer bias, in the transfer region, the toner image on photoreceptor 1 is transferred to intermediate transfer body 6. Thus, intermediate transfer device 5 transfers the toner image to a medium, or intermediate transfer body 6.

Toner which has not been transferred to intermediate transfer body 6 in the transfer region and instead remains on photoreceptor 1 is transported to cleaning device 8 and removed by cleaning device 8. Cleaning device 8 recovers toner which remains on a surface of photoreceptor 1 after the toner image is transferred. Furthermore, photoreceptor 1 having toner on a surface thereof removed by cleaning device 8 is again charged by charging device 2 and a next electrostatic latent image and a next toner image are formed. Such a series of image forming operations is repeated.

As cleaning device 8, typically, a blade cleaning system is adopted in which a cleaning blade in the form of a flat plate composed of an elastic body is abutted against a surface of photoreceptor 1 to remove residual toner on photoreceptor 1.

In imaging unit 10 according to the present embodiment, for the purpose of enhancing the cleaning blade's cleaning ability for toner and also suppressing wear of the photosensitive layer of photoreceptor 1, a function to feed a lubricant on photoreceptor 1 is mounted.

Specifically, a lubricant application adjustment mechanism 7 is disposed upstream of cleaning device 8 (or the cleaning blade) of imaging unit 10. Lubricant application adjustment mechanism 7 feeds a lubricant on photoreceptor 1 and also adjusts toner on photoreceptor 1 in amount to stabilize the thickness of a coating lubricant layer formed on a surface of photoreceptor 1 (or the amount of the lubricant present on the surface of photoreceptor 1). In other words, lubricant application adjustment mechanism 7 applies the lubricant on photoreceptor 1 and also recovers toner present on photoreceptor 1 upstream of cleaning device 8. Lubricant application adjustment mechanism 7 is controlled by controller 50. The structure, behavior, etc of lubricant application adjustment mechanism 7 will be described later.

C. Issue and Solution Means

Hereinafter, an issue to be addressed by image formation apparatus 100 according to the present embodiment and its solution means will be described.

A mechanism which feeds a lubricant according to the present embodiment applies the lubricant to a surface of photoreceptor 1. This lubricant applying configuration is composed mainly of an application brush which abuts against photoreceptor 1 and thus rotates, and a solid lubricant pressed into contact with the application brush. The application brush rotates and thus scrapes off a portion of the solid lubricant and also transports the scraped powdery lubricant to photoreceptor 1 to feed it to a surface of photoreceptor 1. The powdery lubricant transported to photoreceptor 1 is normally drawn on photoreceptor 1 by a fixing mechanism (e.g., a fixing blade abutting against photoreceptor 1) disposed downstream, and thus formed into a film to form a coating lubricant layer on a surface of photoreceptor 1.

As the solid lubricant, what contains a fatty acid of a fatty acid metal salt as a major component is used. As the fatty acid of the fatty acid metal salt, a straight chain hydrocarbon is preferable and for example, myristic acid, palmitic acid, stearic acid, oleic acid, etc. are preferable, and stearic acid is more preferable. As the metal of the fatty acid metal salt, lithium, magnesium, calcium, strontium, zinc, cadmium, aluminum, cerium, titanium, iron, etc. are mentioned. Of these, zinc stearate, magnesium stearate, aluminum stearate, and iron stearate are preferable, and zinc stearate is most preferable in particular.

There is an optimal range for the thickness of the coating lubricant layer on the surface of photoreceptor 1. If the optimal range is departed and the coating lubricant layer is excessively thin, defects such as poor cleaning, and image quality degradation such as a granular noise and a streaky uneven image are caused, and in contrast, if the coating lubricant layer is excessively thick, it facilitates the cleaning blade's edge wear. Furthermore, when the coating lubricant layer on the surface of photoreceptor 1 is uneven in thickness, image density and image quality vary. In other words, it is necessary to have the lubricant in an amount falling within a prescribed range to also stabilize image performance and image quality.

The cleaning blade configuring cleaning device 8 abuts against the surface of photoreceptor 1 to recover residual toner such as toner on photoreceptor 1 that is not yet transferred and toner remaining after the transfer. It is known that in doing so, the blade edge of the cleaning blade abutting against photoreceptor 1 wears away the coating lubricant layer.

When based on such findings, in order to keep the thickness of the coating lubricant layer (or the amount of the lubricant present on the surface of photoreceptor 1) constant, the lubricant feeding rate by the lubricant applying function and the lubricant recovery rate at the blade edge of the cleaning blade may be balanced.

However, the lubricant recovery rate at which the cleaning blade wears and thus recovers the coating lubricant layer depends on the amount of the toner fed to the blade edge. In forming an image when an image area ratio (or a coverage) varies, the amount of the toner fed to the blade edge will vary, and the lubricant recovery rate will also vary. As a result, the lubricant feeding rate and the lubricant recovery rate would be out of balance, and the thickness of the coating lubricant layer on the surface of the image carrier would vary. That is, it is not easy to balance the lubricant feeding rate and the lubricant recovery rate without being affected by the amount of the toner present on photoreceptor 1.

In the present embodiment, based on information of a coverage of a toner image formed on photoreceptor 1, lubricant application adjustment mechanism 7 applies the lubricant, and together therewith or simultaneously therewith, a force of lubricant application adjustment mechanism 7 to scrape off the toner on photoreceptor 1 is adjusted to control the amount of the toner reaching cleaning device 8 (or the cleaning blade) disposed downstream of lubricant application adjustment mechanism 7. That is, the lubricant feeding rate and the lubricant recovery rate are balanced by adjusting the amount of the coating lubricant layer worn by the blade edge of the cleaning blade.

It is believed that this is based on the following mechanism: More specifically, an external additive externally added to the toner departs from the toner on photoreceptor 1. The external additive having departed stagnates upstream of a portion at which the blade edge abuts against photoreceptor 1. The external additive is fine particles of a metal oxide such as silica and titanium (inorganic fine particles), and will wear a surface of photoreceptor 1. Such a stagnant amount of the external additive varies depending on the amount of the toner recovered, and as a result, depending on the amount of the toner recovered, the amount of the lubricant recovered at cleaning device 8 can be varied.

As will be described hereinafter, as lubricant application adjustment mechanism 7, a separate or integral configuration is employed to implement a function to apply the lubricant (a lubricant applying function) and a function to recover toner (a toner recovery function).

Figure 3:
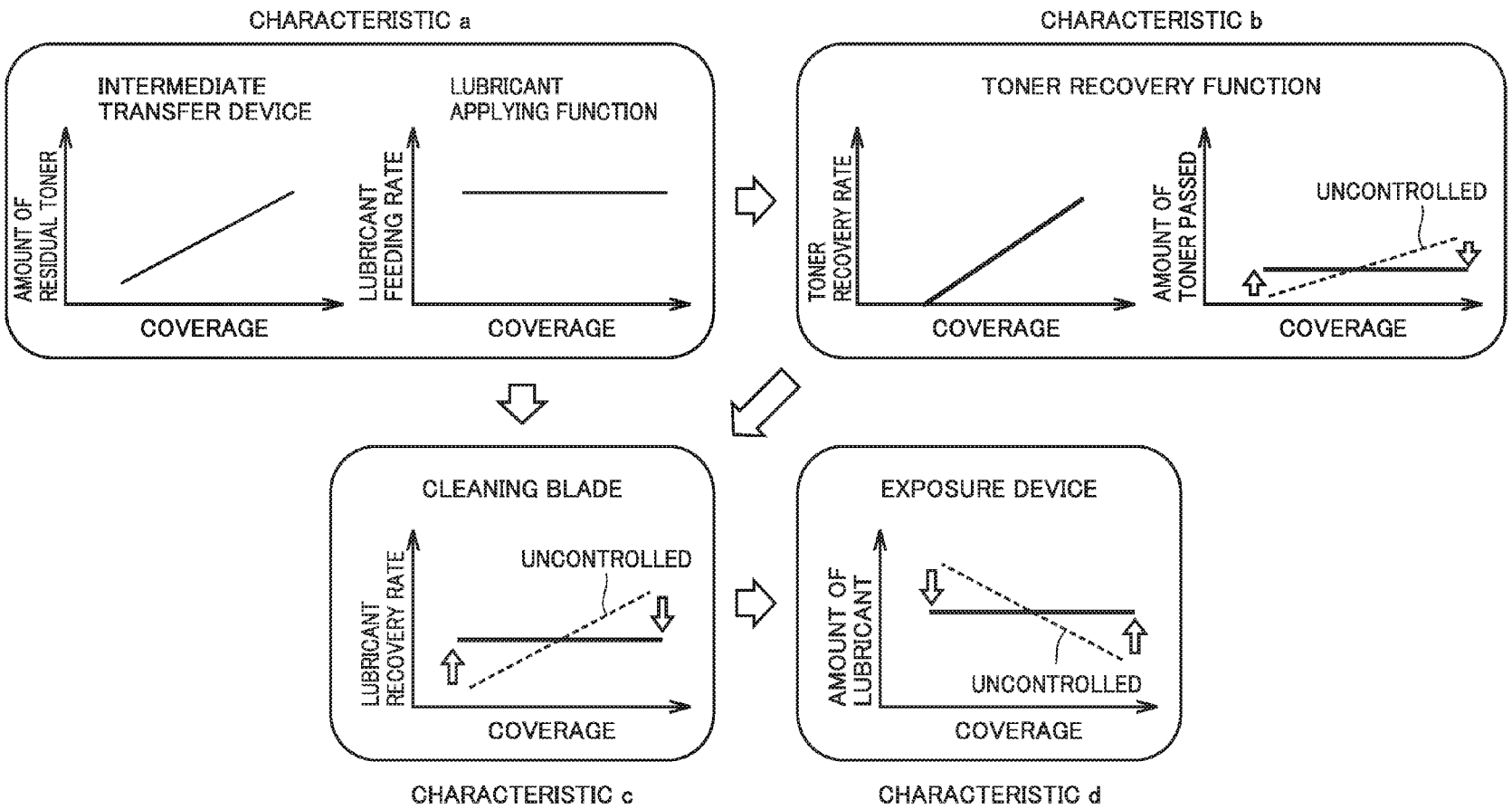
FIG. 3 is a schematic diagram for outlining a process for stabilizing a coating lubricant layer in the image formation apparatus according to the present embodiment.
Figure 4:
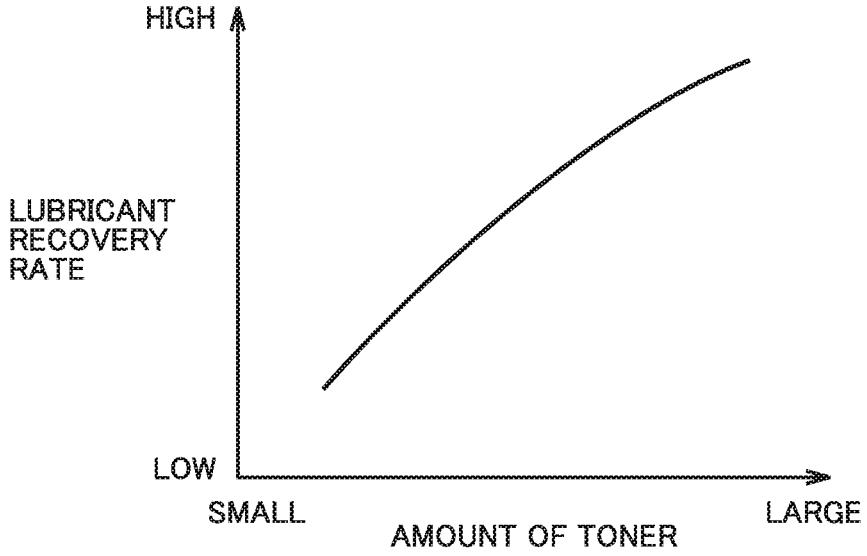
FIG. 4 is a schematic diagram schematically representing a relationship between an amount of toner on a photoreceptor and a lubricant recovery rate by a blade edge of a cleaning blade.

FIG. 3 is a schematic diagram for outlining a process for stabilizing the coating lubricant layer in image formation apparatus 100 according to the present embodiment, and FIG. 4 schematically represents a relationship between an amount of toner on photoreceptor 1 and a lubricant recovery rate by a blade edge of a cleaning blade.

Initially, as represented in FIG. 3 by a characteristic a, basically, an amount of residual toner after a toner image formed on photoreceptor 1 is transferred to intermediate transfer body 6 (i.e., toner that is not yet transferred and toner remaining after the transfer etc.) will be proportional to the size of a coverage. In contrast, the lubricant feeding rate of the lubricant applied to photoreceptor 1 by the lubricant applying function of lubricant application adjustment mechanism 7 is constant regardless of the coverage unless the application brush abutting against photoreceptor 1 and thus rotating has a speed of rotation, a bias voltage and the like variably.

In a conventional configuration, in accordance with a balance between an amount of toner and that of a lubricant that depends on a coverage, as represented in FIG. 3 by characteristic a, cleaning device 8 (or the cleaning blade) does cleaning (see a characteristic c in FIG. 3). Specifically, as shown in FIG. 4, the magnitude of the effect of cleaning device 8 (the cleaning blade) wearing the coating lubricant layer will be proportional to the amount of residual toner on photoreceptor 1 (i.e., the immediately previous image's coverage).

As a result, as shown in FIG. 3 by characteristic c, the amount of the lubricant recovered from photoreceptor 1 per unit time (i.e., the lubricant recovery rate) will be proportional to the coverage's size. As a result, when a small coverage continues, the coating lubricant layer becomes thin, and poor cleaning and defects such as image quality degradation such as a granular noise and a streaky uneven image can be caused. On the contrary, when a large coverage continues, the coating lubricant layer becomes thick, which facilitates the cleaning blade's edge wear. Furthermore, by local variation of a coverage which may be caused on photoreceptor 1, the coating lubricant layer varies in thickness, which may have an adverse effect on cleaning performance and image quality.

In image formation apparatus 100 according to the present embodiment, lubricant application adjustment mechanism 7 has a toner recovery function disposed upstream of cleaning device 8 (or the cleaning blade) to adjust an amount of toner present on photoreceptor 1 passing the cleaning blade. Thus, an effect of a coverage on an effect by the cleaning blade of wearing the coating lubricant layer, is reduced.

As shown in FIG. 3 by characteristic c, the toner recovery function of lubricant application adjustment mechanism 7 recovers more toner on photoreceptor 1 in response to a larger coverage, and in contrast, recovers toner from photoreceptor 1 in a reduced amount in response to a smaller coverage. Thus, the amount of the toner on photoreceptor 1 passing the toner recovery function of lubricant application adjustment mechanism 7 can be more uniform without being influenced by a coverage.

Applying such a toner recovery function allows the amount of the toner on photoreceptor 1 passing the cleaning blade to be uniform, and as a result, an effect by the cleaning blade of wearing the coating lubricant layer (i.e., the lubricant recovery rate) to be also uniform. By reducing the effect of the coverage on the effect of wearing the coating lubricant film, a balance can be maintained between the lubricant feeding rate and the lubricant recovery rate, and the coating lubricant layer on the surface of photoreceptor 1 can also be maintained in thickness within an optimal range in a cycle in which a next toner image is formed. A function represented in FIG. 3 by characteristic b is summarized as follows:

(1) Case in which Coverage is Small (at Time of Small Coverage)

The ability to recover toner by the toner recovery function of lubricant application adjustment mechanism 7 is suppressed to increase the amount of toner fed to the cleaning blade. At the time of a small coverage, residual toner's amount is reduced, and accordingly, the amount of toner which reaches the cleaning blade decreases and accordingly the lubricant recovery rate decreases, which is, however, suppressed.

(2) Case in which Coverage is Larger (at Time of Larger Coverage)

The ability to recover toner by the toner recovery function of lubricant application adjustment mechanism 7 is increased to reduce the amount of toner fed to the cleaning blade. At the time of a large coverage, residual toner's amount increases, and accordingly, the amount of toner which reaches the cleaning blade increases and accordingly the lubricant recovery rate increases, which is, however, suppressed.

The ability to recover toner by the toner recovery function of lubricant application adjustment mechanism 7 can be adjusted by any method for example such as adjusting a bias voltage depending on an amount of electrification of the toner and a charging electrode, adjusting a rotation speed of the application brush which abuts against photoreceptor 1 and thus rotates, etc. These specific methods will be described later.

Control for maintaining a balance between the lubricant feeding rate and the lubricant recovery rate, as described above, is performed by a controller 50. More specifically, as shown in FIG. 3 by characteristic c, when a toner image formed on photoreceptor 1 has a larger image area ratio (or coverage), controller 50 controls the toner recovery function of lubricant application adjustment mechanism 7 to recover more toner, whereas when a toner image formed on photoreceptor 1 has a smaller image area ratio (or coverage), controller 50 controls the toner recovery function of lubricant application adjustment mechanism 7 to suppress recovering toner.

In other words, controller 50 exerts control to enhance an ability of lubricant application adjustment mechanism 7 to recover toner for a larger coverage, whereas controller 50 exerts control to reduce the ability of lubricant application adjustment mechanism 7 to recover toner for a smaller coverage.

By adopting the above described solution means, in image formation apparatus 100 according to the present embodiment, even when a coverage varies, the thickness of the coating lubricant layer (or the amount of the lubricant present on a surface of the image carrier) is minimally varied and can thus be stabilized.

D. First Configuration Example

Hereinafter, imaging unit 10 according to a first configuration example is indicated by way of example as one example which embodies the solution means in the above described present embodiment.

d1: Configuration of Apparatus

Figure 5:
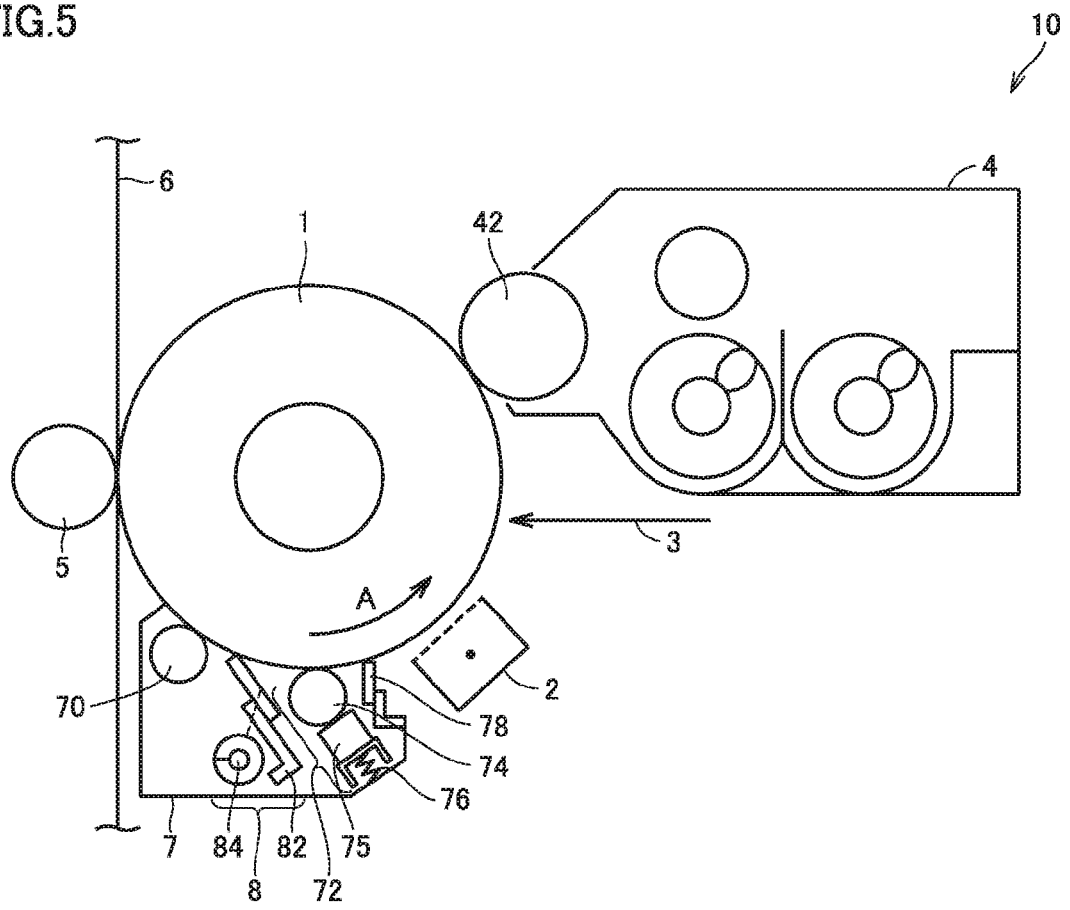
FIG. 5 is a schematic diagram showing a schematic configuration of an imaging unit according to a first configuration example according to the present embodiment.
Figure 6:
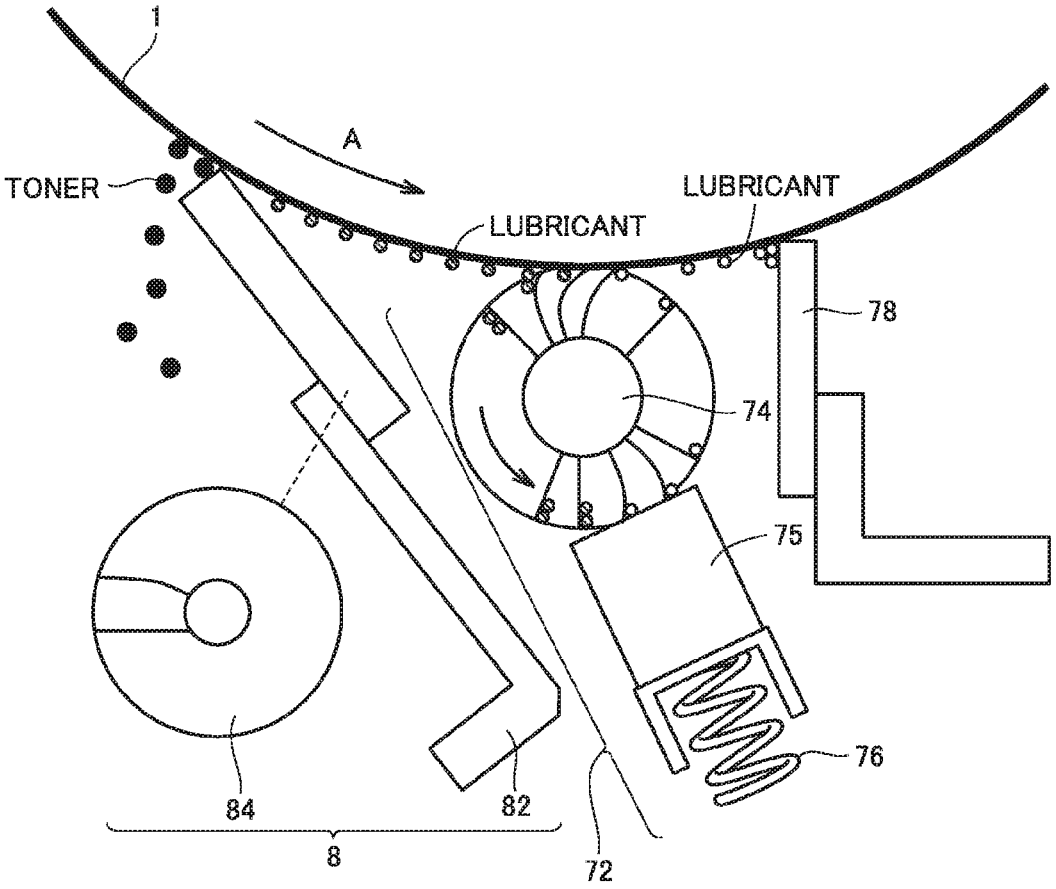
FIG. 6 is a schematic diagram for illustrating how toner and a lubricant behave in the imaging unit shown in FIG. 5.

FIG. 5 schematically shows a configuration of imaging unit 10 according to the first configuration example according to the present embodiment, and FIG. 6 is a schematic diagram for illustrating how toner and a lubricant behave in imaging unit 10 shown in FIG. 5.

FIG. 5 and FIG. 6 show a configuration example of imaging unit 10 in which lubricant application adjustment mechanism 7 has a function to recover toner (i.e., a toner recovery function) and a function to apply a lubricant (i.e., a lubricant applying function) separated with cleaning device 8 interposed. Specifically, imaging unit 10, as observed in the figure in a direction A in order from an upstream side, has a recovery brush 70 which exhibits the toner recovery function, cleaning device 8 (a cleaning blade 82 and a transporting screw 84), a lubricant application device 72, and a fixing mechanism (a fixing blade 78) disposed therein.

Cleaning device 8 includes cleaning blade 82 and transporting screw 84 which transports toner. Typically, cleaning blade 82 is composed of polyurethane rubber or the like processed into a sheet. As transporting screw 84 is rotatably driven, toner recovered by cleaning blade 82 is transported to a toner accommodation unit (not shown).

Lubricant application device 72 is disposed downstream of cleaning device 8. Lubricant application device 72 is composed of an application brush 74 which abuts against photoreceptor 1 and thus rotates, and a solid lubricant 75 pressed into contact with application brush 74. Application brush 74 rotates and thus scrapes off a portion of solid lubricant 75 and also transports the powdery lubricant scraped off solid lubricant 75 to photoreceptor 1 to feed it to a surface of photoreceptor 1. The powdery lubricant transported to photoreceptor 1 is normally drawn on photoreceptor 1 by the fixing mechanism disposed downstream (e.g., fixing blade 78 in the example shown in FIGS. 5 and 6) and thus formed into a film to form a coating lubricant layer on a surface of photoreceptor 1.

Application brush 74 is a rolled brush member, and configured to rotate in a direction opposite to that in which photoreceptor 1 rotates. Solid lubricant 75 is pressed and thus held against application brush 74 by a pressing member 76 composed of a compression spring etc.

Typically, solid lubricant 75 can be a powdery metallic soap molten and shaped. Solid lubricant 75 can for example be a metal soap such as zinc stearate. A coating formed of zinc stearate is characterized by high mold releasability (i.e., a large pure water contact angle) and a small coefficient of friction, and is excellent in transferability and cleanability and can also suppress wear of photoreceptor 1 to allow it to have a long life.

Fixing blade 78, as well as cleaning blade 82, is composed of polyurethane rubber processed into a sheet or the like. Fixing blade 78 abuts preferably in a direction in which it is dragged relative to photoreceptor 1 (such that it is trailed).

With reference to FIG. 6, residual toner present on photoreceptor 1 will be recovered by cleaning blade 82 of cleaning device 8. Furthermore, a portion of the lubricant present on photoreceptor 1 will be recovered by application brush 74 of lubricant application device 72 and also mixed with the powdery lubricant shaved from solid lubricant 75, and again applied to photoreceptor 1.

Subsequently, as the toner recovery function of lubricant application adjustment mechanism 7, recovery brush 70 is disposed upstream of cleaning device 8. Recovery brush 70 is a rolled conductive brush member, and configured to rotate in the same direction as photoreceptor 1. As recovery brush 70 rotates, a portion of residual toner present on photoreceptor 1 is recovered, and the recovered toner is scraped off recovery brush 70 by a flicker member (not shown) and thus accommodated in the accommodation unit.

In the state shown in FIG. 6, cleaning blade 82 of cleaning device 8 scrapes toner, and a portion of an external additive externally added to the toner also departs from the toner. A majority of the external additive having departed remains at a location upstream of a portion at which cleaning blade 82 abuts against photoreceptor 1, and a portion thereof passes cleaning blade 82. Application brush 74 scrapes off the external additive and also feeds the lubricant.

As shown in FIG. 5, lubricant application adjustment mechanism 7 according to the first configuration example has application brush 74 as an abutment member for applying a lubricant to photoreceptor 1 and has recovery brush 70 as an abutment member for recovering toner present on photoreceptor 1. Note that the toner recovery function of lubricant application adjustment mechanism 7 may not be a rolled conductive brush member but a conductive roller.

By controlling the amount of the toner which recovery brush 70 recovers from photoreceptor 1 (i.e., the ability to recover the toner/the toner recovery rate), the amount of the lubricant that cleaning device 8 disposed downstream of recovery brush 70 recovers from photoreceptor 1 (i.e., the lubricant recovery rate) can be controlled.

Typically, the ability to recover the toner by recovery brush 70 is controlled based on a coverage in forming an image. As a mechanism which adjusts the ability to recover the toner, a method can be adopted in which the speed of rotation and/or direction of rotation of recovery brush 70, and the magnitude and/or polarity of a bias voltage applied to recovery brush 70 are adjusted.

More specifically, when recovery brush 70 or a recovery roller is adopted as an abutment member for recovering toner present on photoreceptor 1, controller 50 changes at least one of the speed of rotation of the abutment member (recovery brush 70 or the recovery roller) and the direction of rotation thereof to control the ability to recover the toner. Furthermore, when an electrically conductive member is adopted as the abutment member for recovering the toner present on photoreceptor 1, controller 50 changes at least one of the magnitude of the bias voltage applied to the abutment member and the polarity thereof to control the ability to recover the toner.

A specific example controlling the ability to recover the toner is indicated by way of example in an exemplary experiment for confirming an effect, as will be described hereinafter.

d2: Controlling Ability to Recover Toner

Image formation apparatus 100 according to the present embodiment operates according to a coverage in forming an image to control the ability of a function of lubricant application adjustment mechanism 7 to recover toner (i.e., the toner recovery function). In doing so, basically, a coverage regarding a previously formed toner image will be used.

Typically, image data to be printed in image formation apparatus 100 will once be stored to an internal memory of controller 50 (see FIG. 1), and read sequentially in an order in which it is stored. Controller 50 calculates an image portion (a region in which toner should adhere) of a previously printed image (a previously formed toner image) and a non-image portion (a region in which toner should not adhere) thereof in area (typically the number of dots included in each region), and calculates a value of a coverage from a ratio of the image portion and the non-image portion. Note that a coverage may be calculated from an immediately previous single image or images previously printed on a prescribed number of sheets or over a prescribed period of time.

Figure 7A:
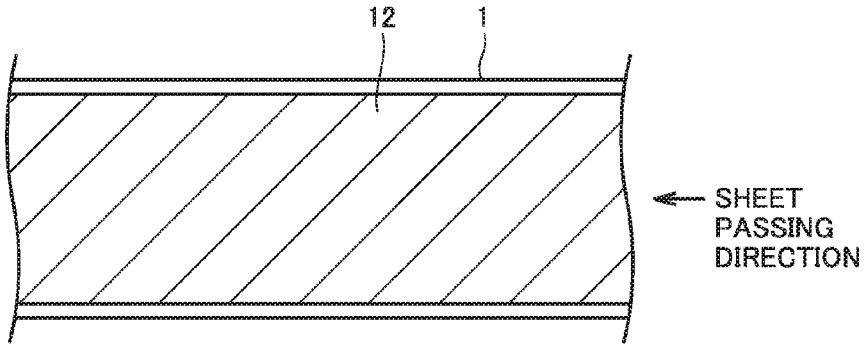
FIG. 7A and FIG. 7B are figures for illustrating an example of a method of calculating a coverage in the image formation apparatus according to the present embodiment.
Figure 7B:
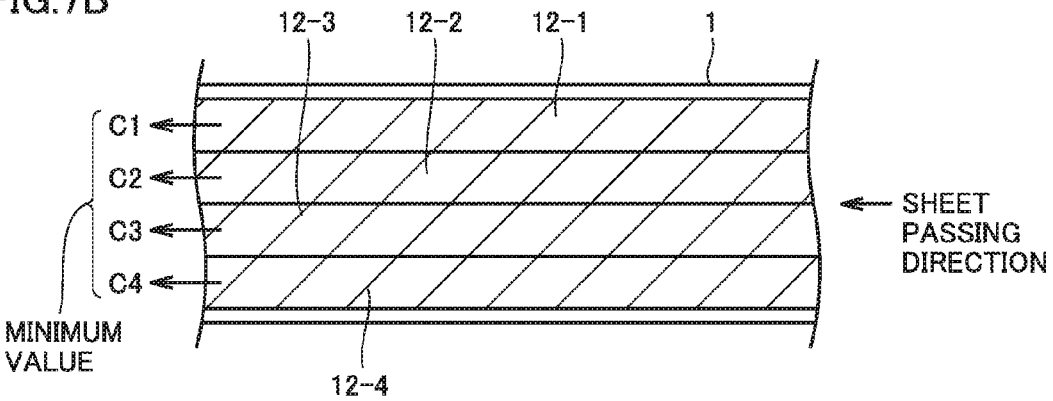

FIG. 7A and FIG. 7B schematically show an example of a method of calculating a coverage in image formation apparatus 100 according to the present embodiment. With reference to FIG. 7A, generally, a toner image can be formed throughout a region of a prescribed width located inside a surface of photoreceptor 1, and that region serves as an image formation region 12. Controller 50 may use an average image area ratio (or average coverage) throughout image formation region 12 on photoreceptor 1 as a coverage of a toner image to be used to control the ability to recover the toner.

Rather than an average value throughout such a region, a local coverage may instead be used. For example, as shown in FIG. 7B, a coverage may be calculated for each of a plurality of divided regions 12-1 to 12-4 obtained by dividing a sheet passing direction in a widthwise direction, and a representative value may be determined from each coverage.

In the present embodiment, severity is increased for smaller coverages, and accordingly, preferably, of the calculated coverages, the minimum value is used as the image area ratio. Thus, controller 50 may adopt as the image area ratio the minimum value of the image area ratios of the plurality of divided regions divided in the main scanning direction of photoreceptor 1.

Alternatively, depending on the situation, the mean value or maximum value of divided regions 12-1 to 12-4 may be used.

Furthermore, as shown in FIG. 1, when forming a color image by superposing toner images of a plurality of colors on one another, a coverage may be calculated for each color (or each color layer) and used. Alternatively, when superposing toner images, there is also an inverted transfer from a toner image of another color, and accordingly, a value of an average of each color's coverage may be used. A more optimal method of calculating a coverage may be used depending on the apparatus's configuration or the like.

d3: Forming a Toner Image Based on a Patch Image

While the process for stabilizing the coating lubricant layer in image formation apparatus 100 according to the present embodiment is also applicable to a normal printing process, it is also applicable in forming a toner image based on a so-called patch image. From a viewpoint of protecting photoreceptor 1 and cleaning device 8 etc., apart from a normal image formation process (i.e., an image formation process corresponding to an input image), when a prescribed condition is satisfied, a toner image based on a so-called patch image is formed, and that toner image is subjected to a process such as cleaning to adjust an amount of toner present on photoreceptor 1. The process for stabilizing the coating lubricant layer according to the present embodiment may also be done in such a case.

More specifically, when a predetermined condition is established, controller 50 of image formation apparatus 100 forms on photoreceptor 1 a toner image based on the patch image. And controller 50 also causes lubricant application adjustment mechanism 7 to process the toner image corresponding to this patch image.

A timing to form the toner image based on the patch image is preferably a period of time for which the normal image formation process is not performed. For example it may include any of: a time when image formation apparatus 100 is powered on (or initialized), a time before an image is formed for an input image; and a time after an image is formed for an input image.

Furthermore, a condition under which the toner image based on the patch image is formed includes conditions which should avoid situations such as degraded cleaning performance, degraded image performance, photoreceptor 1 having a short lifetime and the like. More specifically, it may include any one of: photoreceptor 1's total use time; developing device 4's total use time; a period of time for which image formation apparatus 100 is left without forming any image; and an environment in which image formation apparatus 100 is installed (e.g., temperature, humidity, etc.). Alternatively, these factors may be composited together and therefrom a degree may be calculated, and based on that degree, a condition under which the toner image based on the patch image is formed may be determined.

Preferably, such a patch image for forming a toner image is determined depending on a predetermined pattern or a condition in a timing of execution. In this case, a patch image which has an image area ratio depending on an immediately previous image area ratio may be used. For example, it is preferable that when an image of a larger image area ratio is formed in an immediately previous image formation process, the patch image's image area ratio be reduced, whereas when an image of a smaller image area ratio is formed in an immediately previous image formation process, the patch image's image area ratio be increased.

Note that the toner image based on the patch image may be formed as a portion of an image stabilization process, and when such a point is taken into consideration, it is preferable that in the process for stabilizing the coating lubricant layer according to the present embodiment, the coverage of the toner image formed based on the patch image is not reflected in a subsequent process, i.e., the process for stabilizing the coating lubricant layer. More specifically, it is preferable that controller 50 of image formation apparatus 100 exclude the image area ratio of the patch image from the image area ratio used for controlling lubricant application adjustment mechanism 7.

By forming a toner image based on a patch image, as described above, and controlling lubricant application adjustment mechanism 7 therefor, the coating lubricant layer can be more stabilized.

d4: Procedure of Process

Figure 8:
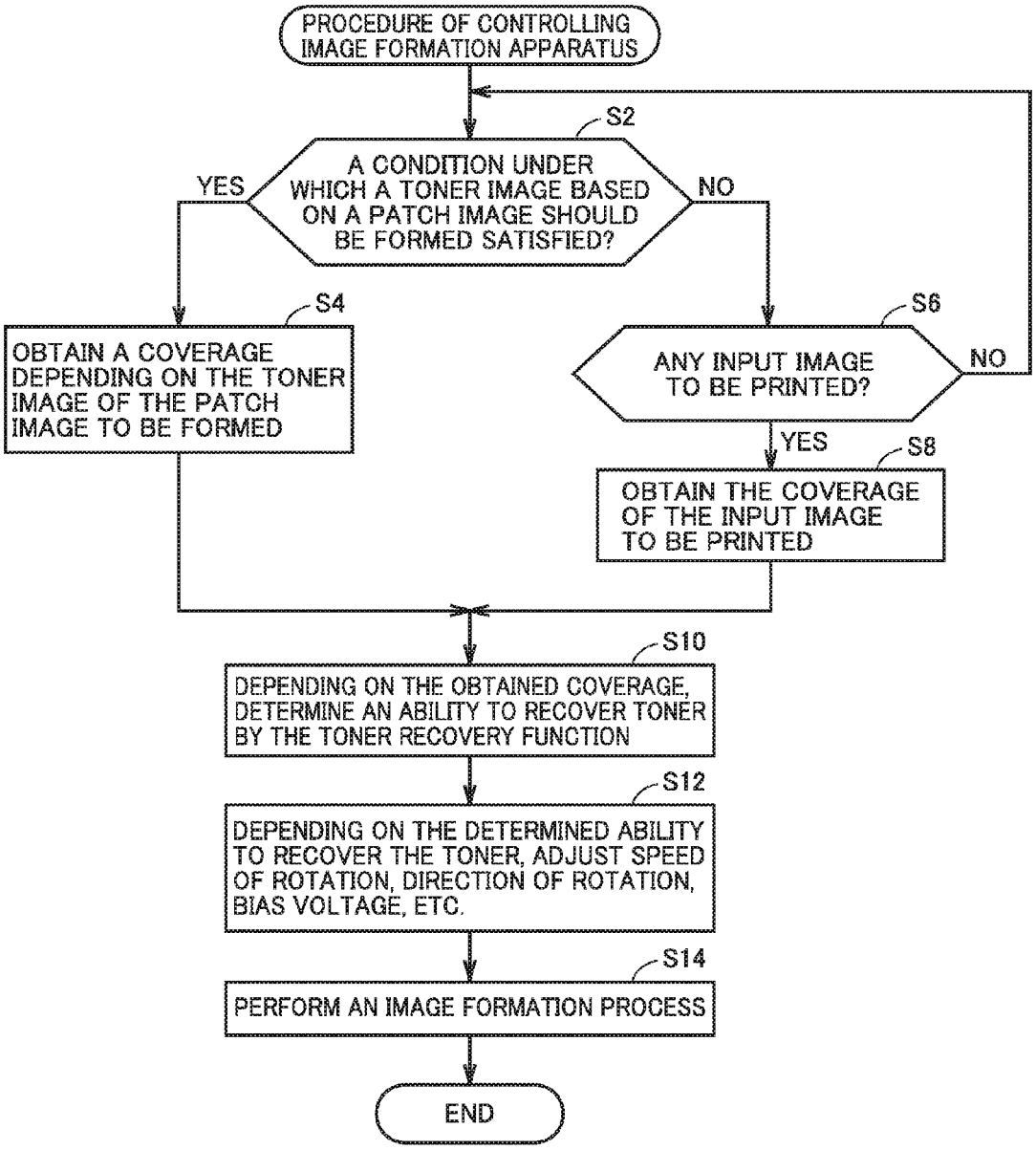
FIG. 8 is a flowchart of a control procedure in the image formation apparatus according to the present embodiment.

Hereinafter, with reference to FIG. 8, a control procedure in image formation apparatus 100 according to the present embodiment will be described. Each step shown in FIG. 8 is typically performed by controller 50 executing a previously installed control program.

Initially, controller 50 determines whether a condition under which a toner image based on a patch image should be formed is satisfied (step S2). When the condition under which the toner image based on the patch image should be formed is satisfied (YES in step S2), controller 50 obtains a coverage depending on the toner image of the patch image to be formed (step S4), and performs a process of step S10 et seq.

On the other hand, when the condition under which the toner image based on the patch image should be formed is not satisfied (NO in step S2), controller 50 determines whether there is any input image to be printed (step S6). When there is no input image to be printed (NO in step S6), step S2 is repeated.

When there is any input image to be printed (YES in step S6), controller 50 obtains the coverage of the input image to be printed (step S8), and performs the process of step S10 et seq.

In step S10, depending on the obtained coverage, controller 50 determines an ability to recover toner by the toner recovery function of lubricant application adjustment mechanism 7 (step S10), and depending on the determined ability to recover the toner, adjusts recovery brush 70's speed of rotation, direction of rotation, bias voltage, etc. (step S12). That is, controller 50 performs the step of obtaining an image area ratio (or coverage) of a toner image formed on photoreceptor 1 (Steps S4, S8), and subsequently, when the obtained image area ratio is larger, controller 50 controls lubricant application adjustment mechanism 7 to recover more toner (step S12). In other words, when the obtained image area ratio is smaller, controller 50 exerts control to suppress recovering toner by lubricant application adjustment mechanism 7.

Finally, controller 50 performs an image formation process for a toner image based on the patch image depending on the image area ratio or a toner image depending on the input image (step S14). And the process ends. The process shown in FIG. 8 will be repeatedly started periodically as prescribed.

E. Result of Confirming an Effect for First Configuration Example

Hereinafter is indicated a result of some experiments (examples 1-3 and comparative examples 1-2) performed to confirm an effect of stabilizing the coating lubricant layer formed on a surface of photoreceptor 1 in image formation apparatus 100 (in the first configuration example) according to the above described present embodiment.

As a specific apparatus configuration, together with the examples and the comparative examples, along the imaging unit according to the first configuration example that is shown in FIG. 5 and FIG. 6, photoreceptor 1, developing device 4, intermediate transfer device 5, lubricant application adjustment mechanism 7 (the lubricant applying function and the toner recovery function), the cleaning blade, etc. were set, as will be described hereinafter. As the image formation apparatus serving as a base, a test prototype based on a digital printing system by Konica Minolta Co., Ltd. "bizhub PRESS C1070" was used.

(1) Photoreceptor 1

As photoreceptor 1 was used a drum-like organic photoreceptor including a drum-like metallic base composed of aluminum and a photosensitive layer composed of polycarbonate resin, formed on a circumferential surface of the metallic base, and having a thickness of 25 μm. Photoreceptor 1 was rotated at 400 mm/sec.

(2) Developing Device 4

As developing device 4 was used what had a developing sleeve rotatably driven at a linear velocity of 600 mm/min, and to this developing sleeve, a bias voltage identical in polarity to a potential of a surface of photoreceptor 1 was applied, and reversal development was performed using a two-component developer.

As toner was used a two-component based developer including toner and a carrier for charging the toner. The toner's particles were produced by an emulsion polymerization method and had a volumetric average particle diameter of 6.5 μm. The toner's particles were negatively charged. The toner was what had fine particles such as silica and titania externally added thereto.

(3) Intermediate Transfer Device 5

As intermediate transfer body 6 a configuration was used in which an endless belt was used which was composed of polyimide resin to which conductance was imparted, and a transfer roller was provided which was abutted against photoreceptor 1 via the belt and received a voltage opposite in polarity to the toner's charging polarity.

(4) Lubricant Application Adjustment Mechanism 7 (Lubricant Applying Function)

As application brush 74, a conductive fur brush formed of conductive nylon fibers (having a resistance of $10^8\Omega$, a thickness of 20 μm, and a fiber density of $3.0\times10^8$ fibers/$m^2$) and having a brush hair length of 3 mm was used and formed in a roll. Application brush 74 had a roller configured to have a diameter of ϕ14 mm. A configuration was made such that a solid lubricant was pressed and thus held against application brush 74 by a pressing member composed of a compression spring. Furthermore, as the solid lubricant was used a metal soap provided in the form of powder and molten and shaped, and as the metallic soap was used zinc stearate.

The direction of rotation of application brush 74 was set opposite (or counter) to the direction of rotation of photoreceptor 1, and it is fixed to 0.5 with a ratio of the speed of rotation of application brush 74 relative to that of photoreceptor 1, i.e., a relative velocity θ2, serving as a standard.

(5) Lubricant Application Adjustment Mechanism 7 (Lubricant Applying Function)

As recovery brush 70, a conductive fur brush formed of conductive nylon fibers (having a resistance of $10^8\Omega$, a thickness of 20 μm, and a fiber density of $3.0\times10^8$ fibers/$m^2$)

and having a brush hair length of 3 mm was used and formed in a roll. The recovery brush had a roller configured to have a diameter of ϕ14 mm.

The direction of rotation of recovery brush 70 was set in the same direction as (or with) the direction of rotation of photoreceptor 1, and a ratio of the speed of rotation of recovery brush 70 relative to the speed of rotation of photoreceptor 1, i.e., a relative velocity θ1, was variable in a range of 0.5-2.0.

(6) Cleaning Blade 82

As cleaning blade 82 was used what was formed of urethane rubber and having a modulus of repulsion elasticity of 50% (at 25 degrees centigrade), a JIS A hardness of 70°, a thickness of 2.00 mm, a free length of 10 mm, and a width of 324 mm. Cleaning blade 82 was set to abut against photoreceptor 1 with a load of 20 N/m at a contact angle of 15 degrees.

Hereinafter, the experimental conditions of Examples 1-3 and comparative examples 1-2 will be described.

e1. Example 1 and Comparative Examples 1-2

Example 1 is a condition setting example for investigating an effect of controlling the speed of rotation of recovery brush 70 of lubricant application adjustment mechanism 7 depending on the image area ratio (or coverage). The setting of Example 1 is shown in the following table, as compared with a setting of a condition to be compared (i.e., comparative example 1 and comparative example 2).

In Example 1, in the configuration of imaging unit 10 shown in FIG. 5, the speed of rotation of recovery brush 70 was varied depending on the size of the coverage. In contrast, in comparative example 1, in the configuration of imaging unit 10 shown in FIG. 5, the speed of rotation of recovery brush 70 was fixed irrespective of the size of the coverage. Furthermore, in comparative example 2, recovery brush 70 was not used.

In any of the cases, the direction of rotation of recovery brush 70 was set in the same direction as photoreceptor 1, and as a bias voltage, a voltage of +200 V was applied to recovery brush 70.

| Image area ratio (Coverage) | Speed of rotation of recovery brush 70 (relative velocity θ1 relative to photoreceptor 1) | | |
|---|---|---|---|
| | Example 1 | Comparative example 1 | Comparative example 2 |
| Less than 5% | 1.1 | 1.4 | no brush |
| 5% to 20% | 1.4 | 1.4 | no brush |
| More than 20% | 1.75 | 1.4 | no brush |

e2. Example 2

Example 2 is a condition setting example for investigating an effect of controlling the direction of rotation and speed of rotation of recovery brush 70 of lubricant application adjustment mechanism 7 depending on the image area ratio (or coverage). The setting of Example 2 is shown in the following table. As well as in example 1, to recovery brush 70, a voltage of +200 V was applied as a bias voltage.

| Image area ratio (Coverage) | control of rotation of recovery brush 70 (relative to photoreceptor 1) | |
|---|---|---|
| | Relative velocity θ1 | Direction of rotation |
| Less than 5% | 1.1 | same direction |
| 5% to 20% | 1.1 | opposite direction |
| More than 20% | 1.75 | opposite direction |

e3. Example 3

Example 3 is a condition setting example for investigating an effect of controlling a bias voltage applied to recovery brush 70 of lubricant application adjustment mechanism 7 depending on the image area ratio (or coverage). The setting of Example 3 is shown in the following table. The direction of rotation of recovery brush 70 was set in the same direction as the direction of rotation of photoreceptor 1, and relative velocity θ1 relative to the speed of rotation of photoreceptor 1 was fixed to 1.4.

| Image area ratio (Coverage) | Bias voltage applied to recovery brush 70 |
|---|---|
| Less than 5% | 0 V |
| 5% to 20% | +200 V |
| More than 20% | +400 V |

e4. Image Assessment Result

Regarding each of Examples 1-3 and comparative examples 1-2 conditioned as set as described above, four types of images having different image area ratios (or coverages) were each passed successively, and at points in time when 10 sheets, 500 sheets, and 2,000 sheets, respectively, of each image have passed, an image noise assessment was done in view of the following two items:

(1) Presence/absence of image noise on an image attributed to poor cleaning in an environment at a temperature of 10 degrees centigrade and a relative humidity of 20% (as visually observed); and (2) Presence/absence of granular unevenness in density appearing in a printing result when one sheet of a half image of an image area ratio of 70% was printed after the sheets have passed (as visually observed).

These two items were totaled and assessed by OK or NG. "OK" means a state where neither image noise attributed to poor cleaning nor granular unevenness in density was caused, and "NG" means a state where any one of image noise attributed to poor cleaning and granular unevenness in density was caused. Hereinafter, an experimental result of each of Examples 1-3 and comparative examples 1-2 is shown.

| | Number of sheets passed | Image area ratio (coverage) | | | |
|---|---|---|---|---|---|
| | | 1% | 5% | 10% | 30% |
| Example 1 | 10 | OK | OK | OK | OK |
| | 500 | OK | OK | OK | OK |
| | 2,000 | OK | OK | OK | OK |

| | Number of sheets passed | Image area ratio (coverage) 1% | 5% | 10% | 30% |
|---|---|---|---|---|---|
| Example 2 | 10 | OK | OK | OK | OK |
| | 500 | OK | OK | OK | OK |
| | 2,000 | OK | OK | OK | OK |

| | Number of sheets passed | Image area ratio (coverage) 1% | 5% | 10% | 30% |
|---|---|---|---|---|---|
| Example 3 | 10 | OK | OK | OK | OK |
| | 500 | OK | OK | OK | OK |
| | 2,000 | OK | OK | OK | OK |

| | Number of sheets passed | Image area ratio (coverage) 1% | 5% | 10% | 30% |
|---|---|---|---|---|---|
| Comparative Example 1 | 10 | OK | OK | OK | OK |
| | 500 | OK | OK | OK | OK |
| | 2,000 | NG | OK | OK | OK |

| | Number of sheets passed | Image area ratio (coverage) 1% | 5% | 10% | 30% |
|---|---|---|---|---|---|
| Comparative Example 2 | 10 | OK | OK | OK | OK |
| | 500 | OK | OK | OK | OK |
| | 2,000 | NG | NG | NG | OK |

e5. Sub-Summary

It can be seen from the above tables that Examples 1-3 generate neither image noise attributed to poor cleaning nor granular unevenness in density even when a large number of sheets are passed (when 2,000 sheets are passed) and that a satisfactory state can be maintained.

In contrast, it can be seen that in comparative example 1, when 2,000 sheets are passed, a defect occurs for an image having an image area ratio (or coverage) of 1%, and that in comparative example 2, when 2,000 sheets are passed, a defect occurs for images having small image area ratios (or coverages) of 1%, 5% and 10%.

Thus, it can be seen that, by mounting a control to stabilize a coating lubricant layer according to the present embodiment, a significant function and effect is obtained as compared with a conventional configuration.

F. Second Configuration Example

Hereinafter an imaging unit 10A will be described by way of example according to a second configuration example as another example which embodies the solution means in the present embodiment as described above.

Figure 9:
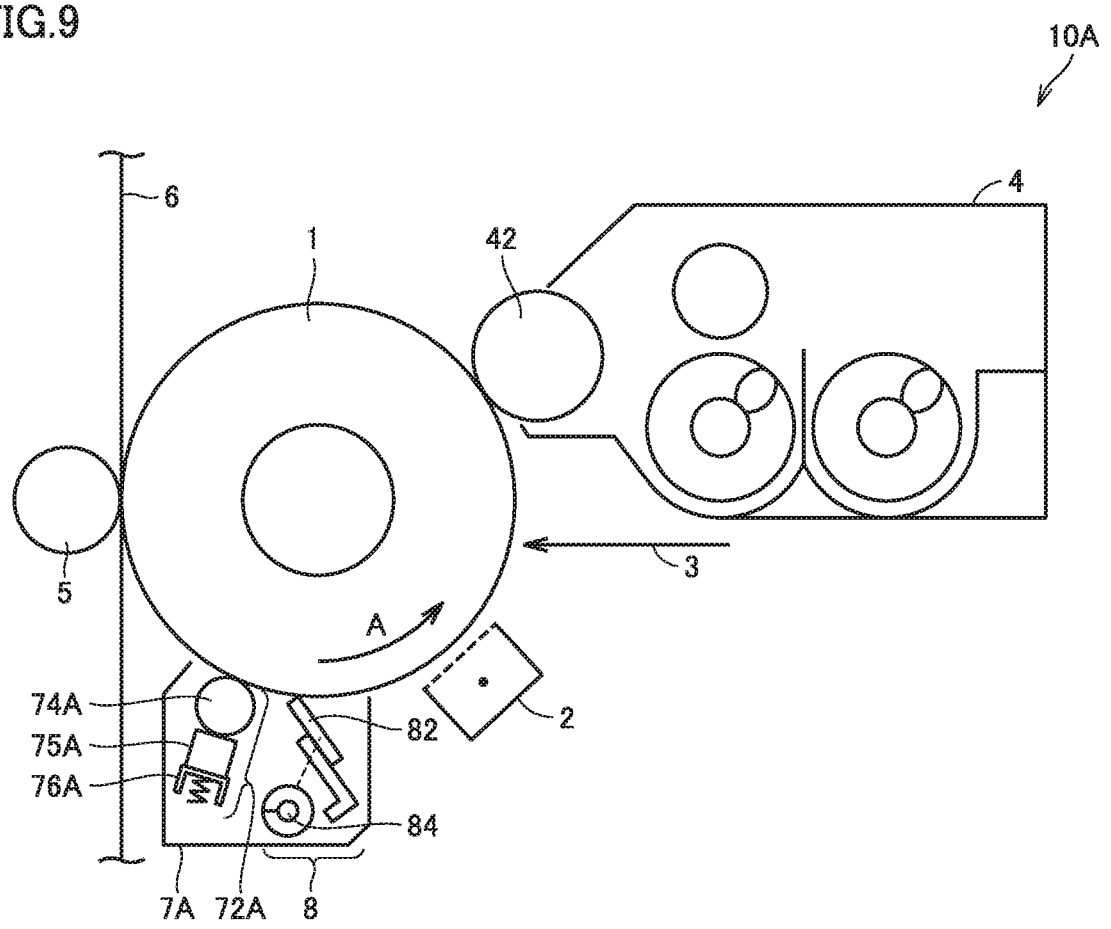
FIG. 9 is a schematic diagram showing a schematic configuration of an imaging unit according to a second configuration example according to the present embodiment.
Figure 10:
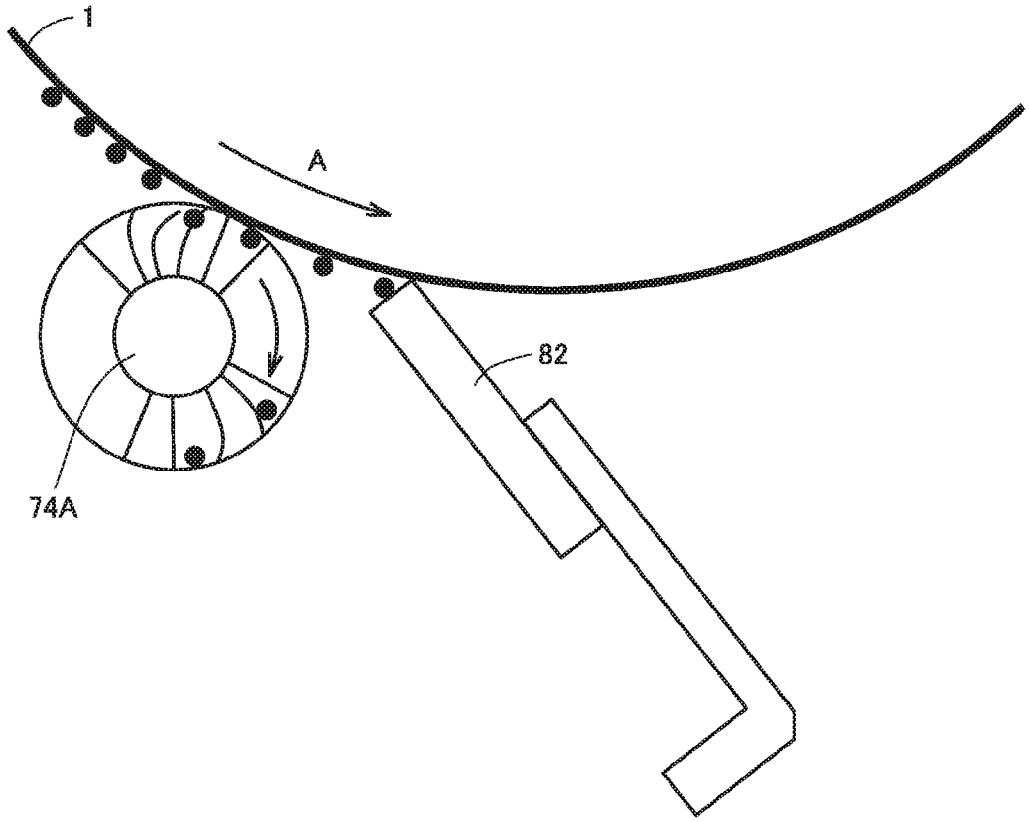
FIG. 10 is a schematic diagram for illustrating how toner and a lubricant behave in the imaging unit shown in FIG. 9.

FIG. 9 schematically shows a configuration of imaging unit 10A according to the second configuration example according to the present embodiment. FIG. 10 is a schematic diagram for illustrating how toner and a lubricant behave in imaging unit 10A shown in FIG. 9.

FIG. 9 and FIG. 10 show an example of mounting a lubricant application adjustment mechanism 7A which serves both a function to recover toner (a toner recovery function) and a function to apply a lubricant (a lubricant applying function). Specifically, imaging unit 10A, as observed in the figure in direction A in order from an upstream side, has a lubricant application device 72A and cleaning device 8 (cleaning blade 82 and transporting screw 84) disposed therein.

Lubricant application adjustment mechanism 7A has lubricant application device 72A also serving the toner recovery function. Lubricant application device 72A is composed of an application brush 74A which abuts against photoreceptor 1 and thus rotates, and a solid lubricant 75 pressed into contact with application brush 74A. Application brush 74A rotates and thus scrapes off a portion of solid lubricant 75A and also transports the powdery lubricant scraped off solid lubricant 75A to photoreceptor 1 to feed it to a surface of photoreceptor 1. In the configuration example shown in FIG. 9 and FIG. 10, cleaning blade 82 of cleaning device 8 also serves as a fixing mechanism for the lubricant. More specifically, the lubricant fed by lubricant application device 72A (i.e., the powdery lubricant shaved from solid lubricant 75) is drawn on photoreceptor 1 by cleaning blade 82 and thus formed into a film to form a coating lubricant layer on a surface of photoreceptor 1.

When lubricant application device 72A applies the lubricant to photoreceptor 1, photoreceptor 1 abuts against application brush 74A and thus rotates, and a portion of toner present on photoreceptor 1 will thus be recovered. As shown in FIG. 10, as application brush 74A abuts against photoreceptor 1 and thus rotates, a portion of toner on photoreceptor 1 will be recovered.

As shown in FIG. 9, lubricant application adjustment mechanism 7A according to the second configuration example has application brush 74A as an abutment member for applying a lubricant to photoreceptor 1 and also recovering toner. Note that it may not be application brush 74A but an application roller.

The ability to recover toner by application brush 74A can be adjusted typically by changing at least one of the speed of rotation and direction of rotation of application brush 74A serving as an abutment member.

That is, in imaging unit 10A according to the second configuration example shown in FIG. 9 and FIG. 10, lubricant application device 72A (or the lubricant applying function) also serves a function to recover toner (the toner recovery function), and the amount of the lubricant applied and the amount of the toner recovered can be controlled by changing the speed of rotation and/or direction of rotation of application brush 74A depending on the coverage of the formed image.

(1) Case in which Coverage is Small (at Time of Small Coverage)

The speed of rotation of application brush 74A of lubricant application device 72A is reduced to suppress the ability to recover toner. As the speed of rotation of application brush 74A is reduced the amount of the lubricant applied to photoreceptor 1 decreases. If the speed of rotation of application brush 74A is not controlled, then, for small coverage, the amount of the lubricant on photoreceptor 1 varies in a direction in which it increases, however, by applying the control according to the present embodiment, the amount of the lubricant applied can be reduced and the lubricant recovery rate can also be increased, that is, a synergetic effect for stabilizing the thickness of the coating lubricant layer can be obtained.

(2) Case in which Coverage is Larger (at Time of Larger Coverage)

The speed of rotation of application brush 74A of lubricant application device 72A is increased to enhance the ability to recover toner. As the speed of rotation of application brush 74A is increased the amount of the lubricant applied to photoreceptor 1 increases. If the speed of rotation of application brush 74A is not controlled, then, for large coverage, the amount of the lubricant on photoreceptor 1 varies in a direction in which it decreases, however, by applying the control according to the present embodiment, the amount of the lubricant applied can be increased and the lubricant recovery rate can also be reduced, that is, a synergetic effect for stabilizing the thickness of the coating lubricant layer can be obtained.

The contents described for items (d2: Controlling ability to recover toner), (d3: Forming a toner image based on a patch image), and (d4: Procedure of process) are also similarly applicable in the second configuration example shown in FIG. 9 and FIG. 10, and accordingly, they will not be described repeatedly in detail.

G. Result of Confirming Effect for Second Configuration Example

Hereinafter is indicated a result of an experiment (example 4) performed to confirm an effect of stabilizing the coating lubricant layer formed on a surface of photoreceptor 1 in image formation apparatus 100 (in the second configuration example) according to the above described present embodiment.

As a specific apparatus configuration, along an imaging unit according to the second configuration example shown in FIG. 9 and FIG. 10, photoreceptor 1, developing device 4, intermediate transfer device 5, lubricant application adjustment mechanism 7A, a cleaning blade, etc. were set, as will be described hereinafter. Except for the configuration of lubricant application adjustment mechanism 7A, the specific apparatus configuration is similar to the configuration described above in the section <E. Result of confirming effect for first configuration example> and accordingly, it will not be described repeatedly in detail.

Example 4 is a condition setting example for investigating an effect of controlling the speed of rotation of application brush 74A of lubricant application adjustment mechanism 7A (i.e., relative velocity θ2 relative to the speed of rotation of photoreceptor 1), depending on the image area ratio (or coverage). The setting of Example 4 is shown in a following table. The direction of rotation of application brush 74A was set in the same direction as the direction of rotation of photoreceptor 1, and to application brush 74A, a voltage of +200 V was applied as a bias voltage.

| Image area ratio (Coverage) | Speed of rotation of application brush 74A (relative velocity θ2 relative to photoreceptor 1) Example 4 |
|---|---|
| Less than 5% | 1.1 |
| 5% to 20% | 1.4 |
| More than 20% | 1.75 |

Regarding Example 4 conditioned as set as described above, a method similar to that described above in the section <E. Result of confirming effect for first configuration example> was employed to assess image noise. An experimental result about Example 4 is indicated below:

| | Number of sheets passed | Image area ratio (coverage) 1% | 5% | 10% | 30% |
|---|---|---|---|---|---|
| Example 4 | 10 | OK | OK | OK | OK |
| | 500 | OK | OK | OK | OK |
| | 2,000 | OK | OK | OK | OK |

It can be seen from the above table that Example 4 generates neither image noise attributed to poor cleaning nor granular unevenness in density even when a large number of sheets are passed (when 2,000 sheets are passed) and that a satisfactory state can be maintained.

H. Summary

An image formation apparatus according to the present embodiment adopts a lubricant application adjustment mechanism having an ability to apply a lubricant (i.e., a lubricant applying function) and an ability to recover toner (i.e., a toner recovery function), and also adjusts the toner recovery function's ability to recover toner depending on an image area ratio (or coverage) in forming an image. In other words, the larger the coverage is, the more toner is recovered from photoreceptor 1, whereas the smaller the coverage is, the less toner is recovered from photoreceptor 1.

By adopting such a configuration and control, even when an image area ratio (or coverage) varies, the thickness of the coating lubricant layer on the photoreceptor (or the amount of the lubricant present on a surface of the image carrier) can be stabilized and a noiseless, satisfactory image can be obtained, and the coating lubricant layer can also be stabilized so that it can also be expected that cleanability is maintained and the photoreceptor's life is increased.

Furthermore, the image formation apparatus according to the present embodiment performs an image forming operation such that the lubricant application adjustment mechanism performs a normal operation, and in parallel therewith, a process is performed for stabilizing the thickness of the coating lubricant layer formed on the photoreceptor (or the amount of the lubricant present on a surface of the image carrier) so that there is no effect on an operation to apply the lubricant or no effect on an image formation cycle time.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. An image formation apparatus comprising:

an image carrier;

a developing device which develops an electrostatic latent image formed on the image carrier as a toner image;

a transfer device which transfers the toner image to a medium;

a cleaning device which recovers toner remaining on the image carrier after the toner image is transferred;

a lubricant application adjustment mechanism which applies a lubricant on the image carrier and recovers toner present on the image carrier upstream of the cleaning device; and a controller for controlling the lubricant application adjustment mechanism, which causes the lubricant application adjustment mechanism to recover more toner when an image area ratio of the toner image formed on the image carrier is larger.

2. The image formation apparatus according to claim 1, wherein:

when the image area ratio is larger, the controller exerts control to enhance an ability to recover toner by the lubricant application adjustment mechanism; and when the image area ratio is smaller, the controller exerts control to lower the ability to recover toner by the lubricant application adjustment mechanism.

3. The image formation apparatus according to claim 2, wherein the lubricant application adjustment mechanism comprises:

a first abutment member for applying a lubricant to the image carrier; and a second abutment member for recovering toner present on the image carrier.

4. The image formation apparatus according to claim 3, wherein:

the second abutment member comprises at least one of a brush and a roller; and the controller changes at least one of a speed of rotation of the second abutment member and a direction of rotation thereof to control the ability to recover the toner.

5. The image formation apparatus according to claim 3, wherein:

the second abutment member comprises a conductive member; and the controller changes at least one of a magnitude of a bias voltage applied to the second abutment member and a polarity thereof to control the ability to recover the toner.

6. The image formation apparatus according to claim 2, wherein the lubricant application adjustment mechanism comprises an abutment member for applying a lubricant to the image carrier and recovering toner.

7. The image formation apparatus according to claim 6, wherein the controller changes at least one of a speed of rotation of the abutment member and a direction of rotation thereof to control the ability to recover the toner.

8. The image formation apparatus according to claim 1, wherein the controller uses as the image area ratio of a toner image an average image area ratio throughout an image formation region on the image carrier.

9. The image formation apparatus according to claim 1, wherein the controller adopts as the image area ratio a minimum value of image area ratios respectively of a plurality of divided regions divided in a main scanning direction of the image carrier.

10. The image formation apparatus according to claim 1, wherein when a predetermined condition is established, the controller exerts control to form on the image carrier a toner image based on a patch image corresponding to the image area ratio, and causes the lubricant application adjustment mechanism to process the toner image corresponding to the patch image.

11. The image formation apparatus according to claim 10, wherein the predetermined condition comprises at least one of:

a time when the image formation apparatus is powered on;

a time before an image is formed for an input image; and a time after an image is formed for an input image.

12. The image formation apparatus according to claim 10, wherein the predetermined condition is determined based on at least one of:

the image carrier's total use time;

the developing device's total use time;

a period of time for which the image formation apparatus is left without forming any image; and an environment in which the image formation apparatus is installed.

13. The image formation apparatus according to claim 10, wherein the controller excludes the patch image's image area ratio from the image area ratio used for controlling the lubricant application adjustment mechanism.

14. A control method in an image formation apparatus, wherein the image formation apparatus comprises an image carrier, a developing device which develops an electrostatic latent image formed on the image carrier as a toner image, a transfer device which transfers the toner image to a medium, a cleaning device which recovers toner remaining on the image carrier after the toner image is transferred, and a lubricant application adjustment mechanism which applies a lubricant on the image carrier and recovers toner present on the image carrier upstream of the cleaning device, the method comprising:

obtaining an image area ratio of a toner image formed on the image carrier; and controlling the lubricant application adjustment mechanism to recover more toner when the obtained image area ratio is larger.

15. The control method according to claim 14, further comprising:

exerting a control to enhance an ability to recover toner by the lubricant application adjustment mechanism when the image area ratio is larger; and exerting a control to lower the ability to recover toner by the lubricant application adjustment mechanism when the image area ratio is smaller.

16. The control method according to claim 14, wherein the image area ratio of the toner image is an average image area ratio throughout an image formation region on the image carrier.

17. The control method according to claim 14, wherein the image area ratio of the toner image is a minimum value of image area ratios respectively of a plurality of divided regions divided in a main scanning direction of the image carrier.

18. The control method according to claim 14, further comprising:

in response to a predetermined condition being established, exerting control to form on the image carrier a toner image based on a patch image corresponding to an image area ratio; and causing the lubricant application adjustment mechanism to process the toner image corresponding to the patch image.

19. The control method according to claim 18, wherein the predetermined condition comprises at least one of:

a time when the image formation apparatus is powered on;

a time before an image is formed for an input image; and a time after an image is formed for an input image.

20. The control method according to claim 18, wherein the predetermined condition is determined based on at least one of:

the image carrier's total use time;

the developing device's total use time;

a period of time for which the image formation apparatus is left without forming any image; and an environment in which the image formation apparatus is installed.

* * * * *